United States Patent [19]

Shekleton et al.

[11] Patent Number: 5,063,745

[45] Date of Patent: Nov. 12, 1991

[54] TURBINE ENGINE WITH PIN INJECTOR

[75] Inventors: Jack R. Shekleton, San Diego; Steven A. Sachrison, LaJolla; Michael W. Sledd, Vista, all of Calif.

[73] Assignee: Sundstrand Corporation, Rockford, Ill.

[21] Appl. No.: 379,548

[22] Filed: Jul. 13, 1989

[51] Int. Cl.[5] ..... F02C 1/00

[52] U.S. Cl. ..... 60/737; 60/738

[58] Field of Search ..... 60/734, 737, 738, 743

[56] References Cited

U.S. PATENT DOCUMENTS

| | | | |
|---|---|---|---|
| 517,310 | 3/1894 | Taylor . | |
| 1,727,111 | 9/1929 | Moore . | |
| 1,837,322 | 12/1931 | Hamilton . | |
| 3,739,576 | 6/1973 | Chamberlain . | |
| 3,961,475 | 6/1976 | Wood . | |
| 4,113,021 | 9/1978 | Werner . | |
| 4,199,934 | 4/1980 | Meyer . | |
| 4,242,863 | 1/1981 | Bailey | 60/738 |
| 4,246,757 | 1/1981 | Heberling . | |
| 4,275,564 | 6/1981 | Kappler et al. | 60/746 |
| 4,374,466 | 2/1983 | Sotheran . | |
| 4,455,839 | 6/1984 | Wuchter . | |
| 4,483,138 | 11/1984 | Willis . | |
| 4,742,684 | 5/1988 | Sotheran . | |

FOREIGN PATENT DOCUMENTS

| | | | |
|---|---|---|---|
| 657789 | 9/1951 | United Kingdom | 60/738 |

*Primary Examiner*—Louis J. Casaregola
*Assistant Examiner*—Timothy S. Thorpe
*Attorney, Agent, or Firm*—Wood, Phillips, Mason, Recktenwald & Vansanten

[57] ABSTRACT

Improved fuel atomization for turbine engines operating at low fuel flows and at high altitudes is accomplished in an engine 10 having an annular combustor 12 by utilizing fuel injectors 18 provided with fuel supply tubes 24 disposed within air tubes 20 wherein the fuel supply tubes 24 each have an exit orifice 26 internally of the corresponding air tube 20 and upstream of an exit orifice 22 thereof with a fuel impingement surface 28 being provided within the air tube 20 in confronting relation to the exit orifice 26 of the fuel supply tube 24 to produce a conical fuel film 36 subjected to pressurized air to enhance fuel atomization.

18 Claims, 1 Drawing Sheet

TURBINE ENGINE WITH PIN INJECTOR

FIELD OF THE INVENTION

This invention relates to gas turbine engines and, more particularly, to gas turbine engines having fuel atomizing pin injectors to enhance reliability.

BACKGROUND OF THE INVENTION

Gas turbine engines include fuel injectors that are used to sustain turbine operation under a variety of operating conditions. In relatively small turbine engines of the type utilized in airborne environments, fuel flows at high altitudes are frequently quite low. This produces a fuel atomization problem inasmuch as typical swirl pressure atomizing start fuel injectors will not spray at the very low fuel flows, e.g., less than three pounds per hour, that are required at high altitudes on the order of 50,000 feet. In high altitude ignition in gas turbine engines, combustor volume must also be maximized, i.e., made available for combustion, to provide sufficient time for reaction. Moreover, the high fuel viscosity encountered in cold high altitude conditions adds further difficulty to achieving reliable operation.

Additionally, while ignition can be attained relatively easily at low speed conditions on the order of no more than ten percent of maximum engine speed, kinetic loading increases significantly with engine acceleration. Under such conditions, blowout may occur, particularly at higher speeds, so it is most important to avoid local overfueling of the typical start injector of the swirl pressure atomizing type as the resulting fuel maldistribution renders kinetic loading, i.e., difficulty in combustion or burning, an even more significant problem. Additionally, it is most important for the main fuel injectors to provide exceptionally good fuel atomization even at low speeds so that fuel evaporation problems do not further compound operational difficulties.

The present invention is directed to overcoming one or more of the above problems.

SUMMARY OF THE INVENTION

It is the principal object of the invention to provide a new and improved turbine engine for enhanced reliability. More specifically, it is an object of the invention to provide a new and improved fuel injection system for a turbine engine which provides excellent fuel atomization to provide reliable high altitude operation with the system design being such that it may be manufactured inexpensively. It is a further object of the invention to provide a fuel supply tube for directing fuel against a fuel impingement surface within an air tube.

An exemplary embodiment of the invention achieves the foregoing objects in a gas turbine engine having an annular combustor defining an annular combustion space therewithin. The annular combustor includes at least one igniter mounted therein together with fuel injection means operatively associated therewith. The fuel injection means is adapted to inject a mixture of fuel and air into the annular combustion space for ignition by the igniter. More specifically, the fuel injection means comprises a fuel tube coupled to a source of fuel and disposed within an air tube coupled to a source of air under pressure.

With this arrangement, the air tube is configured so as to have an exit orifice in communication with the annular combustion space. It is also a feature of the invention that the fuel tube has an exit orifice internally of the air tube and upstream of the exit orifice thereof. Further, the fuel injection means includes a fuel impingement surface within the air tube in confronting relation to the exit orifice of the fuel tube.

In a preferred embodiment, the air tube and fuel tube are generally cylindrical with the exit orifice of the fuel tube being disposed generally concentric with the exit orifice of the air tube and in spaced relation thereto such that the impingement surface is disposed intermediate the exit orifices. The air tube preferably includes a main air passageway leading to and terminating in its exit orifice which is dimensioned smaller than the main air passageway to accelerate the mixture of air and fuel from the fuel injection means. Still further, the fuel tube includes a main fuel passageway leading to and terminating in its exit orifice which is similarly dimensioned smaller than the main fuel passageway to produce an acceleration of fuel from the fuel tube.

In an alternative embodiment, the exit orifice of the fuel tube is dimensioned the same as the main fuel passageway to provide for constant velocity for fuel passing through the fuel tube.

As for the impingement surface, it is advantageously defined by an end of a pin disposed concentric with the exit orifice of the fuel tube so as to be disposed in the path of fuel exiting from the fuel tube. The pin may be supported by the air tube or, alternatively, by the fuel tube but, in any event, it will be configured and dimensioned substantially the same as the exit orifice of the fuel tube so as to produce a generally conical spray or film of fuel directed toward the exit orifice of the air tube. In addition, the end of the pin will be positioned in spaced relation to the exit orifice of the fuel tube so as to substantially entirely intercept the stream of fuel passing through the exit orifice of the fuel tube.

Other objects, advantages and features of the present invention will become apparent from the following specification taken in conjunction with the accompanying drawings.

DETAILED DESCRIPTION OF THE PREFERRED EMBODIMENTS

Figure 1:
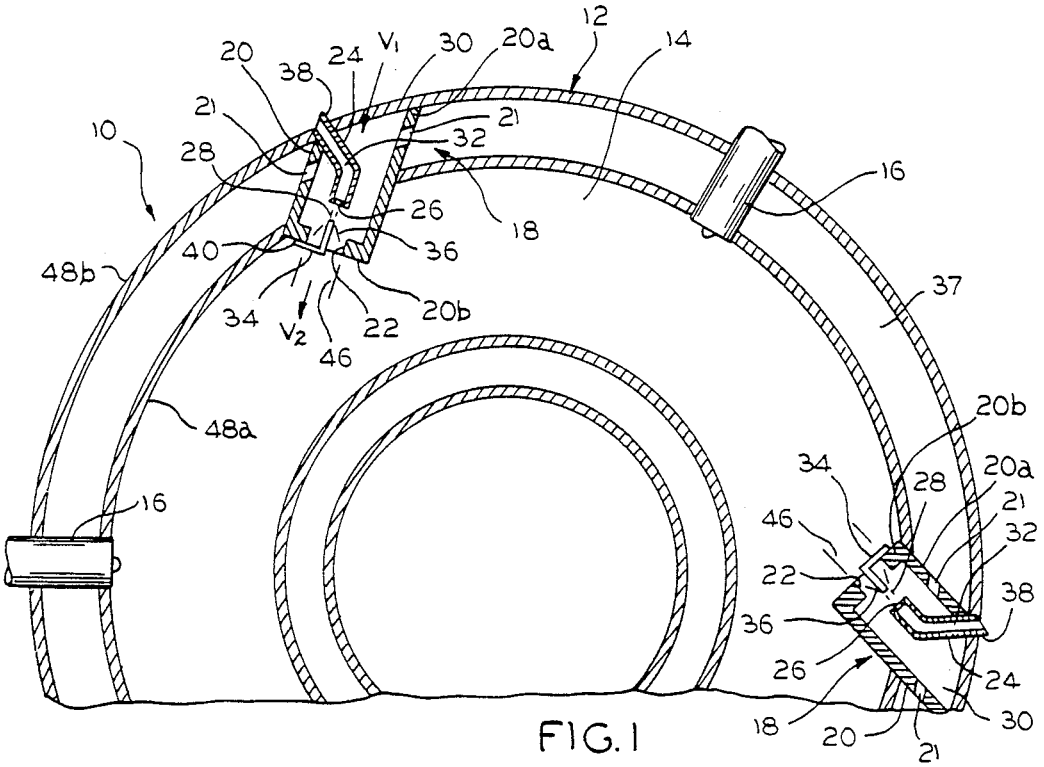
FIG. 1 is a somewhat schematic, sectional view of a turbine engine embodying the invention.

An exemplary embodiment of a gas turbine made according to the invention is illustrated in the drawings in the form of a radial flow, air breathing gas turbine. However, the invention is not limited to radial flow turbines and may have applicability to any form of air breathing turbine having an annular combustor.

Referring to FIG. 1, the reference numeral 10 designates generally a gas turbine engine having an annular combustor 12 defining an annular combustion space 14 therewithin. It will be appreciated that FIG. 1 does not disclose all of the various operational components of the gas turbine engine (most of which are conventional)

but, rather, the unique features of such an engine by utilizing a cross-sectional view of the annular combustor 12 which includes at least one igniter 16 mounted therein. Still further, the annular combustor 12 includes fuel injection means operatively associated therewith for injecting a mixture of fuel and air into the annular combustor 12.

Figure 2:
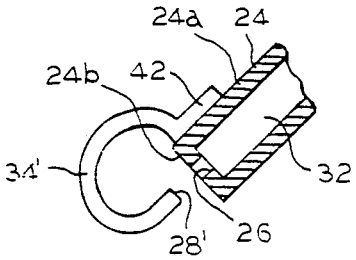
FIG. 2 is a sectional view of an alternative embodiment of pin support for the turbine engine of FIG. 1.

More specifically, the fuel injection means comprises a fuel injector spray nozzle 18 adapted to inject a mixture of fuel and air into the annular combustion space 14 for ignition by the igniter 16. The fuel injector spray nozzle 18 comprises an air tube 20 having a plurality of openings 21 in communication with a source of air (as will be described hereinafter) and having an exit orifice 22 in communication with the annular combustion space 14, and it also comprises a fuel tube 24 disposed within the air tube 20 and coupled to a source of fuel (not shown) wherein the fuel tube 24 also has an exit orifice 26 internally of the air tube 20 and upstream of the exit orifice 22 thereof. Referring to FIGS. 1 and 2, the fuel injector spray nozzle 18 further includes a fuel impingement surface 28 within the air tube 20 in confronting relation to the exit orifice 26 of the fuel tube 24.

As will be appreciated from FIG. 1, the air tube 20 and fuel tube 24 are generally cylindrical in axial cross-section. It will also be noted that the exit orifice 26 of the fuel tube 24 (which is perhaps more aptly referred to as a fuel supply tube) is disposed so as to be generally concentric with the exit orifice 22 of the air tube 20. With this arrangement, the impingement surface 28 is disposed intermediate the exit orifices 22 and 26 of the air tube 20 and fuel supply tube 24, respectively.

Figure 1B:
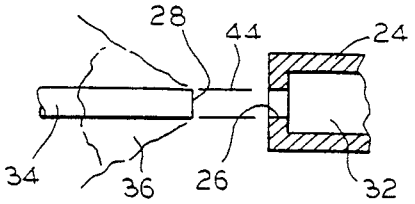
FIG. 1B is a somewhat schematic, sectional view of a portion of the turbine engine of FIG. 1.

Further details include the air tube 20 having a main air passageway 30 leading to and terminating in the exit orifice 22. It will be noted that the exit orifice 22 of the air tube 20 is dimensioned smaller than the main air passageway 30 so as to accelerate the mixture of air and fuel from the fuel injector spray nozzle 18 whereas, in the embodiments illustrated in FIGS. 1 and 1B, the exit orifice 26 of the fuel supply tube 24 is likewise dimensioned smaller than the main fuel passageway 32 to produce an acceleration of fuel as it exits the fuel supply tube 24. As was the case with the air tube 20, the fuel supply tube 24 is configured such that the main fuel passageway 32 leads to and terminates in the exit orifice 26.

Figure 1A:
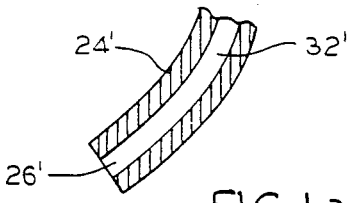
FIG. 1A is an alternative embodiment of fuel tube for the turbine engine of FIG. 1.

In an alternative embodiment illustrated in FIG. 1A, the fuel tube 24' also includes a main fuel passageway 32' leading to and terminating in an exit orifice 26'. However, in this embodiment the exit orifice 26' is dimensioned the same as the main fuel passageway 32' whereby fuel travels at a constant velocity entirely through the fuel supply tube 24'.

As will be appreciated by referring once again to FIGS. 1 and IB, the impingement surface 28 is defined by an end of a pin 34. It will be appreciated that the end of the pin 34 is disposed concentric with and in spaced relation to the exit orifice 26 of the fuel tube 24. Further, the end of the pin 34 is dimensioned so as to substantially entirely intercept fuel from the fuel supply tube 24 (see FIG. 1B).

Still more particularly, the pin 34 can advantageously be supported by the air tube 20 as will be appreciated by referring specifically to FIG. 1. At least the end of the pin 34 defining the impingement surface 28 is then advantageously configured and dimensioned substantially the same as the exit orifice 26 of the fuel tube 24. As a result, the end of the pin 34 produces a generally conical spray or film of fuel as at 36 directed toward the exit orifice 22 of the air tube 20 (see both FIGS. 1 and 1B).

Alternatively, the pin 34' can advantageously be supported by the fuel tube 24 as will be appreciated by referring specifically to FIG. 2. However, it is again desirable for the end defining the impingement surface 28' of the pin 34' to be configured and dimensioned substantially the same as the exit orifice 26 of the fuel supply tube 24. As before, the end the pin 34' will then produce a generally conical spray or film of fuel directed toward the exit orifice 22 of the air tube 20.

Referring specifically to FIG. 1, the fuel injector spray nozzle 18 comprises a body defined substantially entirely by the air tube 20. This body which comprises a generally cylindrical wall 20*a* having openings 21 in communication with a source of air in the combustor annulus 37 and terminating in a radially inwardly directed end cap 20*b* containing the restricted exit orifice 22, may support the fuel supply tube 24 which may, as illustrated, pass through the cylindrical wall 20*a* as at 38. Also as shown, the pin 34 may be supported by the radially inwardly directed end cap 20*b* as at 40 by any conventional means such as welding or the like.

In the case of the embodiment as illustrated in FIG. 2, the pin 34' may be supported in a similar fashion by a cylindrical wall 24*a* as at 42 wherein the cylindrical wall 24*a* terminates in a radially inwardly directed end cap 24*b* containing the restricted exit orifice 26 to thereby define the fuel supply tube 24. In either case, the impingement surface 28 or 28' defined by the end of the pin 34 or 34' will be concentric with, configured and dimensioned substantially the same as, and disposed in spaced relation to the exit orifice 26 or 26' of the fuel supply tube 24 or 24', respectively.

As will now be appreciated, the fuel injector spray nozzle 18 comprises an alternative impingement type of main fuel injector. Fuel is delivered via the fuel supply tube 24 or 24' to the exit orifice 26 or 26' which can be sharp edged as shown in FIG. 1 for minimum pressure loss and maximum orifice size but can be an orifice of substantial length (see FIG. 1A) if manifold head compensation is to be maximized at ignition at very high altitudes. In any event, a fuel jet 44 impacts what is preferably a circular pin 34 or 34' which is concentric with and substantially the same diameter as the exit orifice 26 or 26'.

Even at very low fuel flows on the order of three pounds per hour and less with very high viscosities (30 centistokes and more) with very low fuel pressures on the order of ten psi and less, a generally conical fuel spray or film 36 is formed. A typical film would look like a bubble, i.e., a very thin film (see FIG. 1B). Typically, the fuel atomization would be relatively poor under such conditions but at higher pressure drops very good fuel atomization is achieved since viscous losses such as those encountered in the spin chamber of swirl fuel injectors is absent.

Unlike swirl injectors, the fuel injector spray nozzle of the present invention provides a very high energy transfer from fuel pressure to fuel atomization. As a result, exceptionally good fuel atomization is achieved under low fuel pressure, low fuel flows, and high viscosity where conventional injectors would not function.

Most importantly, air flows through the air blast tube 20 and then is accelerated with atomized fuel through the exit orifice 22 to produce what can be described as an air/fuel jet 46 (see FIG. 1). It will be noted that the air/fuel jet 46 has a trajectory in a circumferential direction about the flame zone of the combustor 12 partly by reason of the fact that the fuel injector spray nozzle 18 is mounted, usually by means of a slide fit, such that the exit orifice 22 of the air blast tube 20 is disposed at an angle to the inner and outer combustor walls 48*a* and 48*b* defining the combustor annulus 37 or, alternatively, to the dome of the combustor. With this arrangement, the air accelerates from a relatively low velocity V1 to a relatively high velocity $V_2$ as it passes through the exit orifice 22 of the air blast tube 20.

As will be appreciated, the values for $V_1$ and $V_2$ will depend upon the particular application and various parameters including relative dimensions, air and fuel pressures, etc. It should be noted, however, that the only criteria is that the velocity of air must be sufficient to shatter the thin fuel film 36. This will produce the highly desirable fuel atomization which can be attained by means of the present invention such that ignition can be achieved under a wide variety of operating conditions. It should be noted, further, than an air velocity of 75 ft/sec, which is extremely low by current practice, will suffice, in low speed starting applications. As a result, the fuel injector spray nozzle 18 can be configured so as to serve as a main fuel injector therefore obviating the need for a separate start injector.

Figure 3:
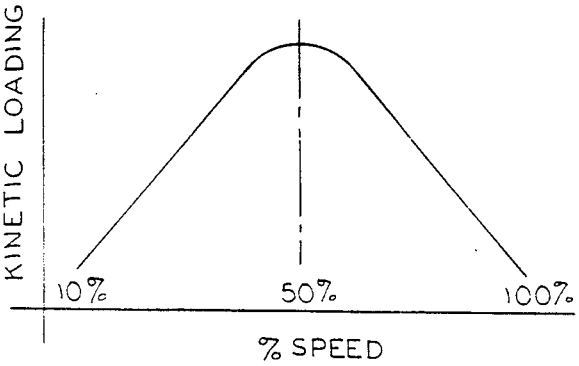
FIG. 3 is a graph illustrating kinetic loading in a turbine engine of the type illustrated in FIG. 1.

As the engine accelerates through the critical maximum kinetic loading condition (see FIG. 3) the increasing fuel flow provides further improvements in atomization. Thus, there are no impediments to combustion as a result of deficiencies in fuel atomization with resulting poor fuel evaporation as in the past. At full speed conditions, exceptionally fine fuel atomization is achieved from fuel pressure alone.

Further, with high velocity air flow, very rapid fuel evaporation and, therefore, very low exhaust smoke, with optimized fuel atomization is achieved.

While in the foregoing there have been set forth preferred embodiments of the invention, it will be appreciated that the invention is only to be limited by the true spirit and scope of the appended claims.

We claim:

1. A fuel injector spray nozzle for a combustor, comprising:

a body including an in air tube coupled to a source of air under pressure and having an exit orifice, a fuel supply tube within said air tube and coupled to a source of fuel and having an exit orifice internally of said air tube upstream of said exit orifice of said air tube, and a fuel impingement surface within said air tube in confronting relation to said exit orifice of said fuel supply tube, said exit orifice of said fuel supply tube being disposed generally concentric with said exit orifice of said air tube, said impingement surface being disposed concentric with and intermediate said exit orifices of said air tube and said fuel supply tube to intercept fuel from said exit orifice of said fuel supply tube upstream of said exit orifice of said air tube to produce a generally conical spray or film of fuel atomized by air flowing through said air tube at a point upstream of said exit orifice thereof, said exit orifice of said air tube accelerating and discharging said atomized fuel and air directly into said combustor.

2. The fuel injector spray nozzle as defined by claim 1 wherein said air tube and fuel supply tube are generally cylindrical.

3. The fuel injector spray nozzle as defined by claim 2 wherein said air tube includes a main air passageway leading to and terminating in said exit orifice of said air tube, said exit orifice of said air tube having a diameter smaller than a diameter of said main air passageway to accelerate a mixture of air and fuel as it exits from said body.

4. The fuel injector spray nozzle as defined by claim 2 wherein said fuel supply tube includes a main fuel passageway leading to and terminating in said exit orifice of said fuel supply tube, said exit orifice of said fuel supply tube having a diameter smaller than a diameter of said main fuel passageway to produce an acceleration of fuel as it exits from said fuel supply tube.

5. The fuel injector spray nozzle as defined by claim 2 wherein said fuel supply tube includes a main fuel passageway leading to and terminating in said exit orifice of said fuel supply tube, said exit orifice of said fuel supply tube having a diameter the same as a diameter of said main fuel passageway to provide for constant velocity for fuel as it passes through said fuel supply tube.

6. The fuel injector spray nozzle as defined by claim 2 wherein said impingement surface is defined by an end of a pin, said end of said pin being disposed in spaced relation to said exit orifice of said fuel supply tube, said end of said pin substantially entirely intercepting all fuel exiting from said fuel supply tube.

7. A gas turbine engine, comprising:

an annular combustor defining an annular combustion space therewithin, said annular combustor including at least one igniter mounted therein, said annular combustor including fuel injection means operatively associated therewith;

said fuel injection means being positioned to inject a mixture of fuel and air into said annular combustion space for ignition by said igniter therewithin, said fuel injection means comprising an air tube coupled to a source of air under pressure and having an exit orifice in communication with said annular combustion space and a fuel tube within said air tube and coupled to a source of fuel and having an exit orifice internally of said air tube upstream of said exit orifice of said air tube, said fuel injection means further including a fuel impingement surface within said air tube in confronting relation to said exit orifice of said fuel tube; and said exit orifice of said fuel tube being disposed generally concentric with said exit orifice of said air tube, said impingement surface being disposed concentric with and intermediate said exit orifices of said air tube and said fuel tube to intercept fuel from said exit orifice of said fuel supply tube upstream of said exit orifice of said air tube to produce a generally conical spray or film of fuel atomized by air flowing through said air tube at a point upstream of said exit orifice thereof, said exit orifice of said air tube accelerating and discharging said atomized fuel and air directly into said annular combustion space.

8. The gas turbine engine as defined by claim 7 wherein said air tube and fuel tube are generally cylindrical.

9. The gas turbine engine as defined by claim 8 wherein said air tube includes a main air passageway leading to and terminating in said exit orifice of said air tube, said exit orifice of said air tube having a diameter smaller than a diameter of said main air passageway to accelerate said mixture of air and fuel from said fuel injection means.

10. The gas turbine engine as defined by claim 8 wherein said fuel tube includes a main fuel passageway leading to and terminating in said exit orifice of said fuel tube, said exit orifice of said fuel tube having a diameter smaller than a diameter of said main fuel passageway to produce an acceleration of fuel form said fuel tube.

11. The gas turbine engine as defined by claim 8 wherein said fuel tube includes a main fuel passageway leading to and terminating in said exit orifice of said fuel tube, said exit orifice of said fuel tube having a diameter the same as a diameter of said main fuel passageway to provide for constant velocity for fuel passing through said fuel tube.

12. The gas turbine engine as defined by claim 8 wherein said impingement surface is defined by an end of a pin, said end of said pin being disposed in spaced relation to said exit orifice of said fuel tube, said end of said pin substantially entirely intercepting all fuel from said fuel tube.

13. The gas turbine engine as defined by claim 12 wherein said pin is supported by said air tube, at least said end of said pin being configured and having a diameter substantially the same as a diameter of said exit orifice of said fuel tube, said end of said pin producing a generally conical spray of fuel directed toward said exit orifice of said air tube.

14. A gas turbine engine, comprising:

an annular combustor defining an annular combustion space therewithin, said annular combustor including at least one igniter mounted therein, said annular combustor including fuel injection means operatively associated therewith;

said fuel injection means being positioned to inject a mixture of fuel and air into said annular combustion space for ignition by said igniter therewithin, said fuel injection means comprising an air tube coupled to a source of air under pressure and having an exit orifice in communication with said annular combustion space and a fuel tube within said air tube and coupled to a source of fuel and having an exit orifice internally of said air tube upstream of said exit orifice of said air tube, said fuel injection means further including a fuel impingement surface within said air tube in confronting relation to said exit orifice of said fuel tube;

said air tube and fuel tube being generally cylindrical, said exit orifice of said fuel tube being disposed so as to be generally concentric with said exit orifice of said air tube, said impingement surface being disposed concentric with and intermediate said exit orifices of said air tube and said fuel tube; and said impingement surface being defined by an end of a pin, said end of said pint being disposed in spaced relation to said exit orifice of said fuel tube, said end of said pin substantially entirely intercepting all fuel from said fuel tube;

said end of said pin intercepting said fuel upstream of said exit orifice of said air tube to produce a generally conical spray or film of fuel atomized by air flowing through said air tube at a point upstream of said exit orifice thereof such that said exit orifice of said air tube accelerates and discharges said atomized fuel and air directly into said combustor.

15. The gas turbine engine as defined by claim 14 wherein said air tube includes a main air passageway leading to and terminating in said exit orifice of said air tube, said exit orifice of said air tube having a diameter smaller than a diameter of said main air passageway to accelerate said mixture of air and fuel from said fuel injection means.

16. The gas turbine engine as defined by claim 14 wherein said fuel tube includes a main fuel passageway leading to and terminating in said exit orifice of said fuel tube, said exit orifice of said fuel tube having a diameter smaller than a diameter of said main fuel passageway to produce an acceleration of fuel from said fuel tube.

17. The gas turbine engine as defined by claim 14 wherein said fuel tube includes a main fuel passageway leading to and terminating in said exit orifice of said fuel tube, said exit orifice of said fuel tube having a diameter the same as a diameter of said main fuel passageway to provide for constant velocity for fuel passing through said fuel tube.

18. The gas turbine engine as defined by claim 14 wherein said pin is supported by said air tube, at least said end of said pin being configured and having a diameter substantially the same as a diameter of said exit orifice of said fuel tube, said end of said pin producing a generally conical spray of fuel directed toward said exit orifice of said air tube.

* * * * *